US009145821B2

(12) United States Patent
Lee et al.

(10) Patent No.: US 9,145,821 B2
(45) Date of Patent: Sep. 29, 2015

(54) ENGINE HAVING MULTI FLOW RATE CONTROL VALVE

(71) Applicants: Hyundai Motor Company, Seoul (KR); Kia Motors Corporation, Seoul (KR)

(72) Inventors: Philgi Lee, Suwon-si (KR); Jae Hoon Oh, Yongin-si (KR); Jae Suk Park, Suwon-si (KR)

(73) Assignees: HYUNDAI MOTOR COMPANY, Seoul (KR); KIA MOTORS CORPORATION, Seoul (KR)

( * ) Notice: Subject to any disclaimer, the term of this patent is extended or adjusted under 35 U.S.C. 154(b) by 0 days.

(21) Appl. No.: 14/304,743

(22) Filed: Jun. 13, 2014

(65) Prior Publication Data

US 2015/0176470 A1 Jun. 25, 2015

(30) Foreign Application Priority Data

Dec. 20, 2013 (KR) ..... 10-2013-0160438

(51) Int. Cl.
*F01P 3/00* (2006.01)
*F01P 7/14* (2006.01)

(52) U.S. Cl.
CPC ..... *F01P 7/14* (2013.01); *F01P 2007/146* (2013.01)

(58) Field of Classification Search
USPC ..... 123/41.08, 41.09, 41.1; 137/625.16, 137/625, 625.11, 625.12, 625.15
See application file for complete search history.

(56) References Cited

U.S. PATENT DOCUMENTS 7,168,397 B2 * 1/2007 Chanfreau et al. ..... 123/41.01
2009/0308335 A1 * 12/2009 Dipaola et al. ..... 123/41.1

FOREIGN PATENT DOCUMENTS

| | | | |
|---|---|---|---|
| JP | 2005-155630 | A | 6/2005 |
| JP | 2009-144624 | A | 7/2009 |
| JP | 2013-177843 | A | 9/2013 |
| KR | 20-2003-0035926 | Y1 | 2/2004 |
| KR | 10-2005-0061626 | A | 6/2005 |
| KR | 10-1283086 | B1 | 7/2013 |

* cited by examiner

*Primary Examiner* — Hung Q Nguyen
(74) *Attorney, Agent, or Firm* — Morgan, Lewis & Bockius LLP

(57) ABSTRACT

An engine having a multi flow rate control valve may include a valve, a valve housing and a driving unit. The valve may have a hollow pipe structure and coolant holes through which a coolant supplied to a space at a center portion of the valve is to be distributed and cooled outside of the valve. The valve housing may be coupled with the valve such that an inner side of the valve housing is capable of being in close contact with an outer side of the valve, and have coolant outlets formed at positions corresponding to the coolant holes. The driving unit may rotate the valve to selectively connect the respective coolant holes to the corresponding coolant outlets or close the coolant holes by bringing them in close contact with the inner side of the valve housing.

10 Claims, 6 Drawing Sheets

ENGINE HAVING MULTI FLOW RATE CONTROL VALVE

CROSS-REFERENCE TO RELATED APPLICATION

The present application claims priority of Korean Patent Application Number 10-2013-0160438 filed on Dec. 20, 2013, the entire contents of which application are incorporated herein for all purposes by this reference.

BACKGROUND OF INVENTION

1. Field of Invention

The present invention relates to an engine having a multi flow rate control valve that maximizes cooling efficiency for an engine and improves combustion efficiency of the engine by integrally controlling coolants supplied to a cylinder block, a cylinder head, a heater, a transmission, and a radiator.

2. Description of Related Art

At present, multi flow rate control valves are used to control the coolant of engines. Those multi flow rate control valves can improve the entire cooling efficiency and reduce fuel consumption by distributing a coolant that is supplied to a bypass line, a transmission oil warmer, a radiator, a cylinder block, and a heater and controlling the coolants supplied to the parts to be cooled in accordance with the driving state.

FIG. 1 is a schematic diagram of a multi flow rate control valve of the related art. Referring to FIG. 1, the control valve supplies a coolant to a radiator 130, a heater 110, and a bypass line 120 and improves the entire cooling efficiency by controlling the coolants supplied to the radiator 130, the heater 110, and the bypass line 120.

A study for controlling coolants that are supplied to the right cylinder block and the left cylinder block in a V-type engine has been conducted and a study for separately cooling a cylinder block and a cylinder head and separately controlling coolants that are supplied to parts to be cooled has been conducted.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

The present invention has been made in an effort to provide an engine having a multi flow rate control valve having advantages of improving the entire fuel efficiency and reducing fuel consumption by an engine by separately controlling coolants that are supplied to the right cylinder block and the left cylinder block in a V-type engine and by separately cooling the cylinder blocks and the cylinder heads.

Various aspects of the present invention provide an engine having a multi flow rate control valve including: a valve having a hollow pipe structure and coolant holes through which a coolant supplied to a space at a center portion of the valve is to be distributed and cooled outside of the valve; a valve housing coupled with the valve such that an inner side of the valve housing is capable of being in close contact with an outer side of the valve, and the valve housing having coolant outlets formed at positions corresponding to the coolant holes; and a driving unit for rotating the valve to selectively connect the respective coolant holes to the corresponding coolant outlets or close the coolant holes by bringing them in close contact with the inner side of the valve housing.

The coolant holes may include: an engine bypass hole connected with a coolant line bypassing an engine; a cylinder block hole connected with a coolant line for a cylinder block; a heater hole connected with a coolant line for a heater; a transmission oil hole connected with a coolant line for heating oil in a transmission; and a radiator hole connected with a coolant line for a radiator.

The coolant holes may be formed in areas in a rotational direction of the valve.

The engine bypass hole, the cylinder block hole, the heater hole, the transmission oil hole, and the radiator hole may be arranged in a predetermined order at predetermined distances in a longitudinal direction of the valve. The engine bypass hole, the cylinder block hole, the heater hole, the transmission oil hole, and the radiator hole may be formed in angular areas in a rotational direction of the valve, respectively.

The valve may be rotated by a motor.

The coolant outlets may include: an engine bypass outlet corresponding to the engine bypass hole; a cylinder block outlet corresponding to the cylinder block hole; a heater outlet corresponding to the heater hole; a transmission oil outlet corresponding to the transmission oil hole; and a radiator outlet corresponding to the radiator hole. The cylinder block outlet may include a left cylinder block outlet corresponding to a left cylinder block and a right cylinder block outlet corresponding to a right cylinder block.

An expansion space with a gap between the outer side of the valve and the inner side of the valve housing may be formed on the inner side of the valve housing, corresponding to one or more coolant holes, and may be connected with one or more coolant outlets.

The engine having a multi flow rate control valve may further include an insert having a pipe structure corresponding to the valve, disposed between the valve housing and the valve, fixed to the valve housing, and having a passage through which the coolant flows to one or more of the coolant outlets from the center portion of the valve.

Protrusions that protrude toward the insert and fix the insert may be formed on the inner side of the valve housing. An expansion space with a gap between the outer side of the insert and the inner side of the valve housing may be formed and connected with one or more of the coolant outlets.

According to the present invention, since the coolants to be supplied to the engine, the radiator, the cylinder block, the heater, and the transmission oil through the coolant holes formed through the vale are controlled separately, depending on the rotational positions of the valve having a pipe structure, it is possible to improve cooling efficiency of the entire engine and reduce fuel consumption.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
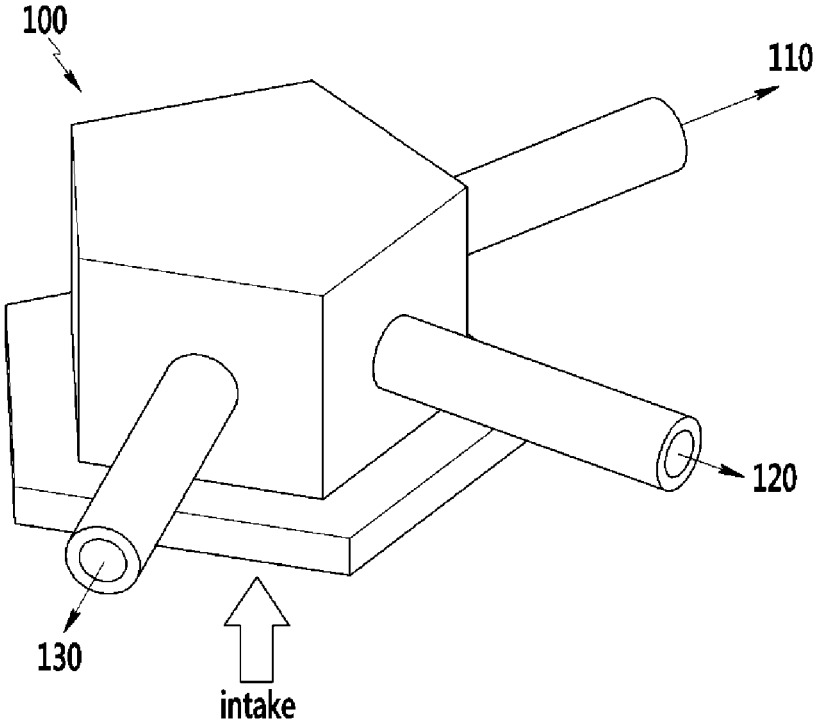
FIG. 1 (Related Art)
FIG. 1 is a schematic diagram of a multi flow rate control valve of the related art.
Figure 2:
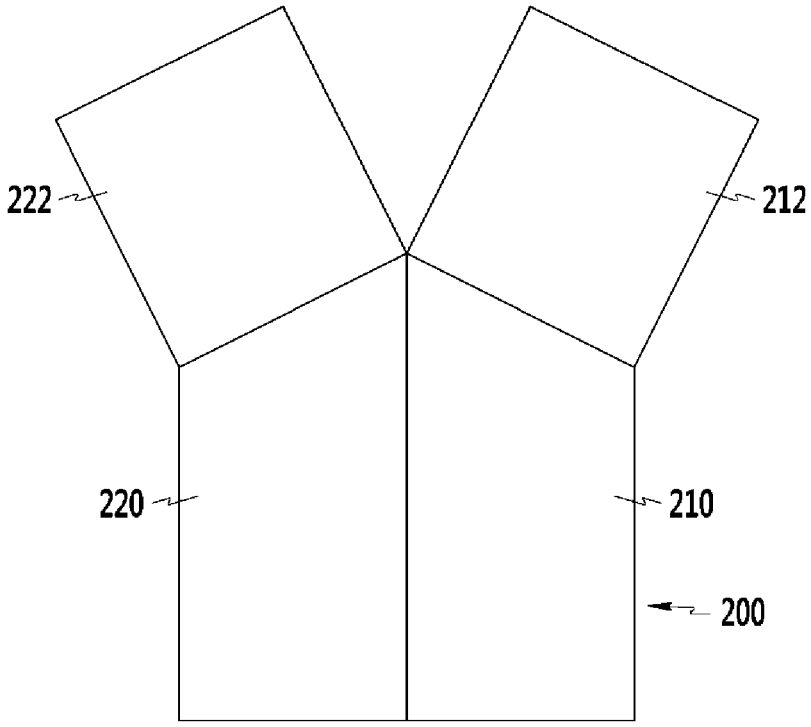
FIG. 2 is a schematic diagram of an exemplary engine having a multi flow rate control valve according to the present invention.

FIG. 2 is a schematic diagram of an engine having a multi flow rate control valve according to various embodiments of the present invention. Referring to FIG. 2, an engine 200 includes a right cylinder block 210 at the right side, a left cylinder block 220 at the left side, a right cylinder head 212 over the right cylinder block 210, and a left cylinder head 222 over the left cylinder block 220.

In the engine, which is a V-type engine, a coolant separately circulates through the right cylinder block 210 and the left cylinder block 220, such that the coolant are not mixed and the cooling efficiency of the entire engine is improved.

A coolant may circulate selectively through the right cylinder block 210 and the left cylinder block 220 and a coolant may keep circulating through the right cylinder head 212 and the left cylinder head 222.

Figure 3:
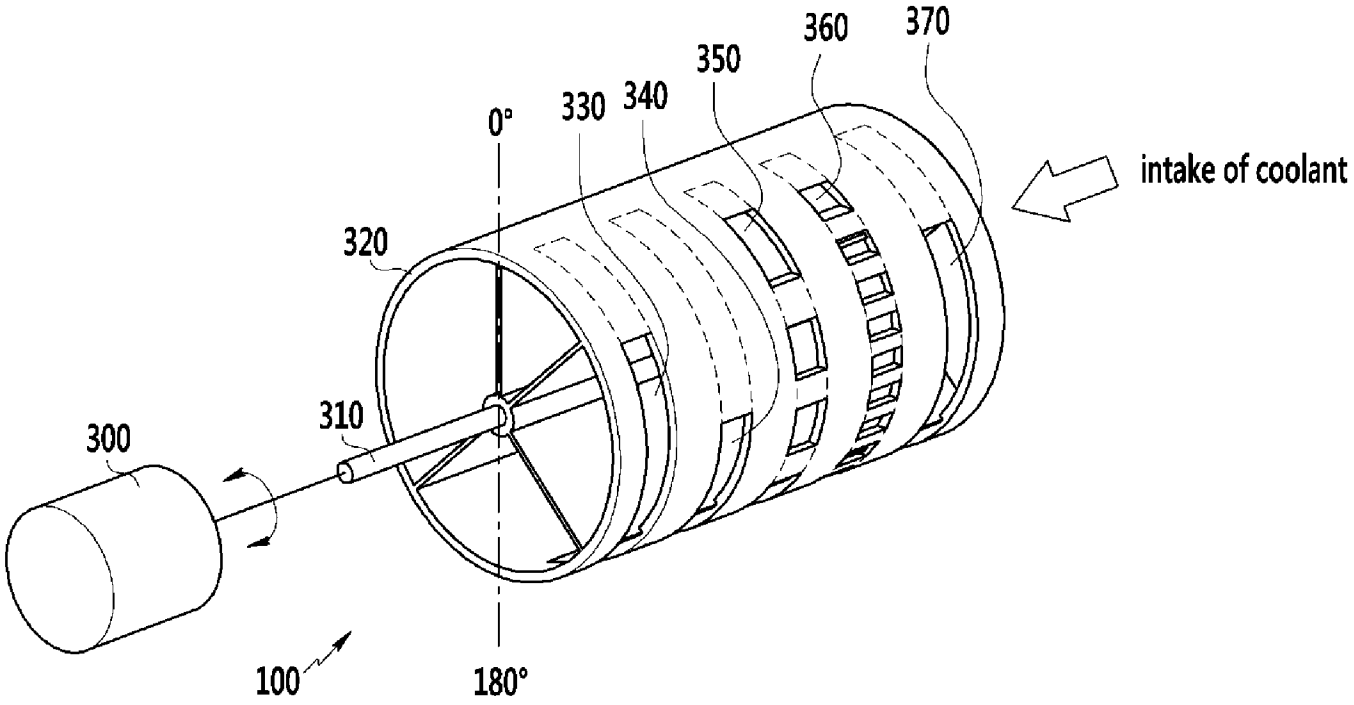
FIG. 3 is a perspective view showing a portion of an exemplary multi flow rate control valve according to the present invention.

FIG. 3 is a perspective view showing a portion of the multi flow rate control valve according to various embodiments of the present invention. Referring to FIG. 3, a multi flow control valve 100 includes a motor 300, a shaft 310, and a valve 320, in which a gear box that reduces the rotation speed and increase torque of the motor 300 may be further disposed between the motor 300 and the shaft 310.

The control valve 100 has a cylindrical pipe-shaped structure, in which a coolant flow inside through one side and a coolant hole through which a coolant flows from the internal space to the outside is formed. The coolant hole includes an engine bypass hole 330, a cylinder block hole 340, a heater hole 350, a transmission oil hole 360, and a radiator hole 370.

The engine bypass hole 330, the cylinder block hole 340, the heater hole 350, the transmission oil hole 360, and the radiator hole 370 are formed in areas defined in the rotational direction of the valve 320. Such areas may be angular areas in the rotational direction of the valve 320. In some embodiments, the engine bypass hole 330, the cylinder block hole 340, the heater hole 350, the transmission oil hole 360, and the radiator hole 370 are sequentially formed in the longitudinal direction of the valve 320 and the arrangement order may change.

The valve 320, which rotates about the longitudinal central axis, is rotated by torque transmitted through the shaft 310 on the central axis from the motor 300.

Depending on the rotational positions of the valve 320, the coolant bypassing the engine through the engine bypass pipe 330 is controlled, the coolant to be supplied to the left cylinder block 220 and the right cylinder block 210 through the cylinder block hole 340 is controlled, the coolant to be supplied to the heater through the heater hole 350 is controlled, the coolant to be supplied to the transmission oil warmer (ATF warmer) through the transmission oil hole 360 is controlled, and the coolant to be supplied to the radiator through the radiator hole 370 is controlled.

The coolant flowing inside through a side of the valve 320 circulates through the engine bypass hole 330, the cylinder block hole 340, the heater hole 350, the transmission oil hole 360, and the radiator hole 370, and a coolant may keep supplied to the right cylinder head 212 and the left cylinder head 222 through the other side of the valve 320.

Figure 4:
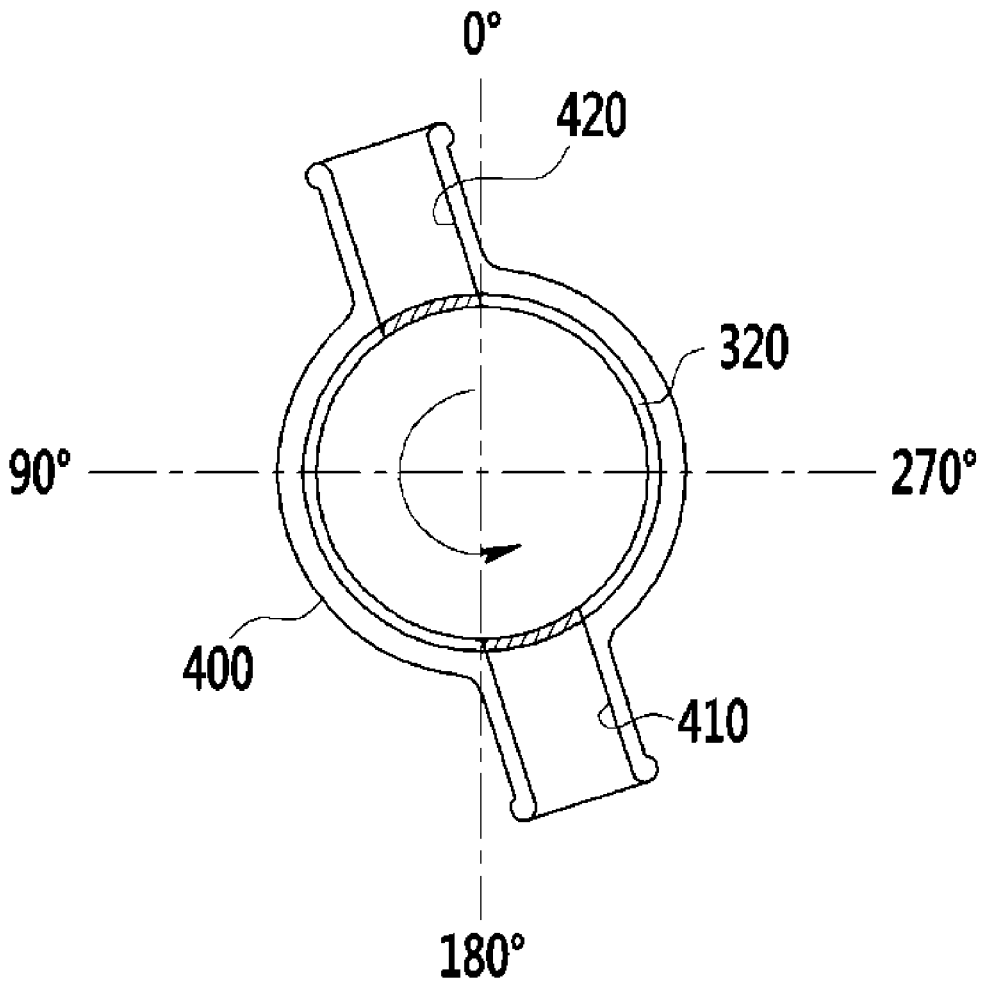
FIG. 4 is a schematic cross-sectional view of an exemplary multi flow control valve according to the present invention.

FIG. 4 is a schematic cross-sectional view of a multi flow control valve according to a first exemplary embodiment of the present invention. Referring to FIG. 4, the multi flow rate control valve includes a valve housing 400, the inner side of the valve housing 400 and the outer side of the valve 320 are in close contact, and the valve 320 slides and rotates in the valve housing 400.

An engine bypass outlet 410 and a radiator outlet 420 are formed at both sides of the valve housing 400, respectively, corresponding to the engine bypass hole 330 and the radiator hole 370. In an exemplary embodiment of the present invention, the angles of the positions where the engine bypass outlet 410 and the radiator outlet 420 may be changed.

Figure 5:
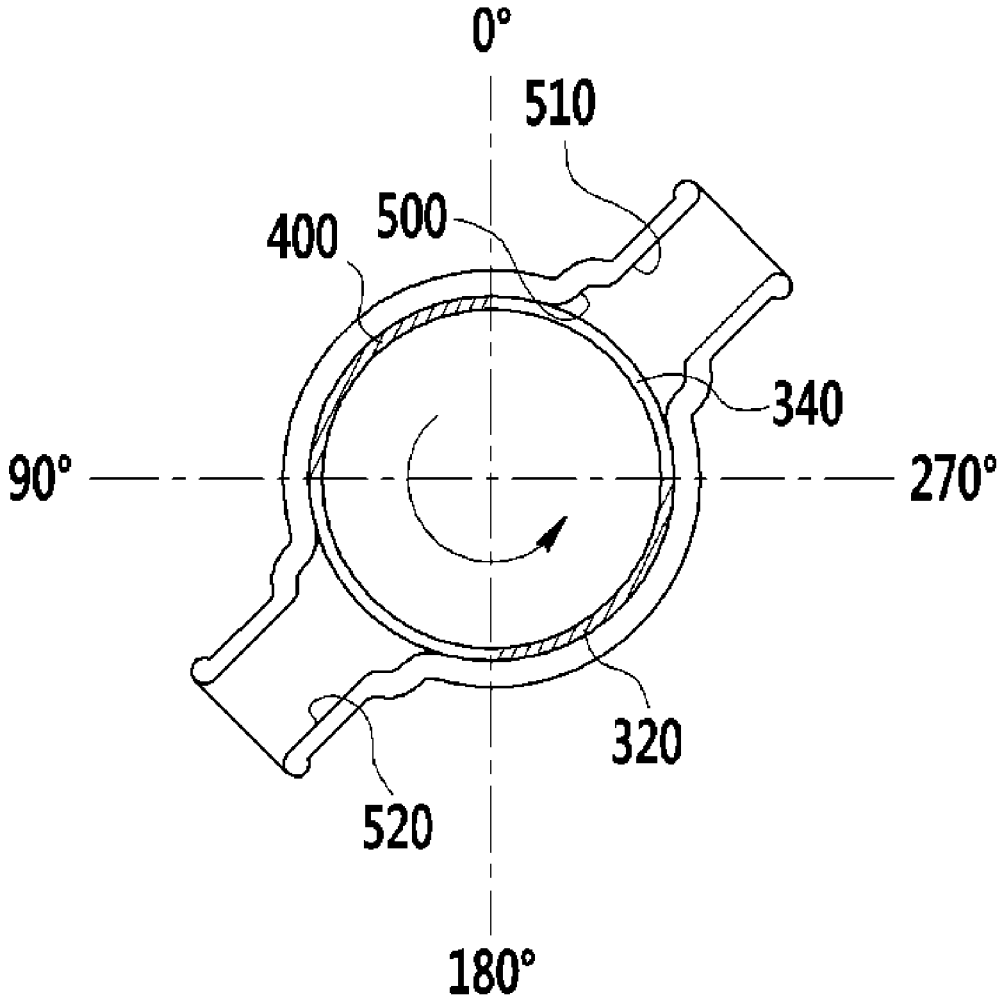
FIG. 5 is a schematic cross-sectional view of another exemplary multi flow control valve according to the present invention.

FIG. 5 is a schematic cross-sectional view of a multi flow control valve according to a second exemplary embodiment of the present invention. Referring to FIG. 5, a cylinder block hole 340 is formed in the valve 320, the cylinder block hole 340 has a left cylinder block hole and a right cylinder block hole, and a left cylinder block outlet 510 corresponding to the left cylinder block hole and discharging a coolant to the left cylinder block 220 and a right cylinder block outlet 520 corresponding to the right cylinder block hole and discharging a coolant to the right cylinder block 210 are formed in a valve housing 400.

An expansion space 500 with a predetermine gap is formed on the inner side of the valve housing 400, between the outer side of the valve 320 and the inner side of the valve housing 400, and is connected with the left cylinder block outlet 510 and the right cylinder block outlet 520.

Accordingly, the coolant flowing through the expansion space 500 and the cylinder block hole 340 of the valve 320 is efficiently sent to the left cylinder block outlet 510 or the right cylinder block outlet 520.

Figure 6:
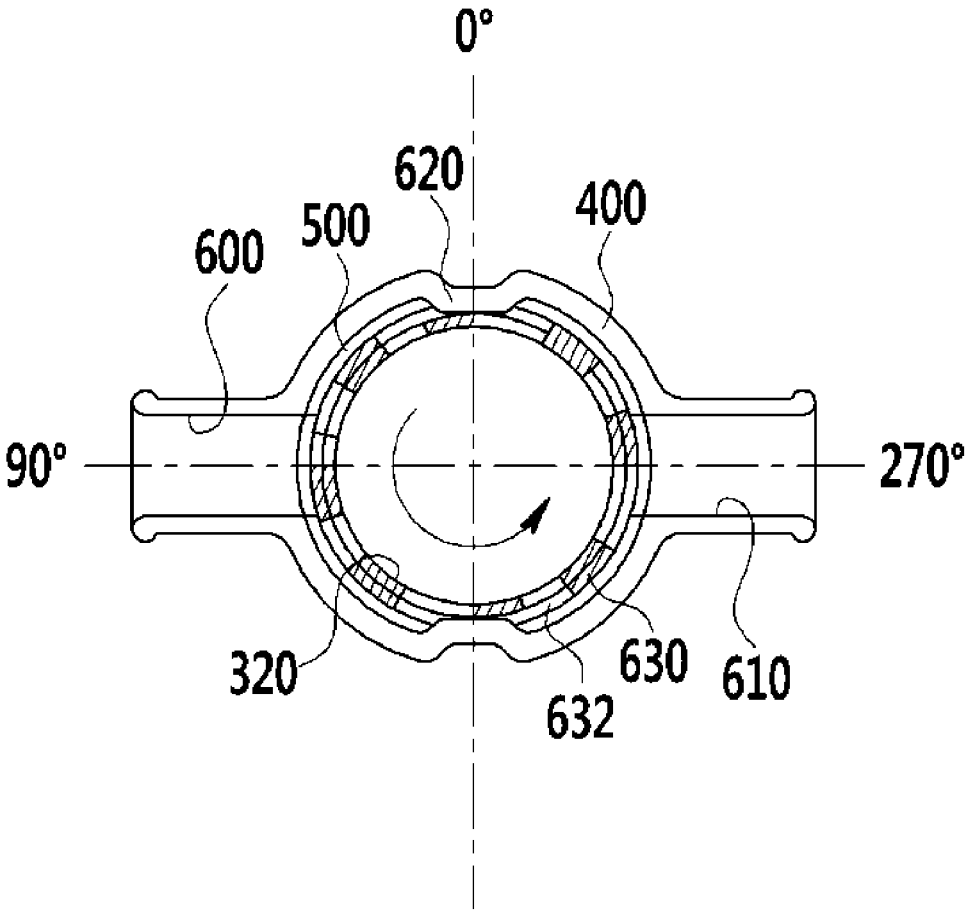
FIG. 6 is a schematic cross-sectional view of still another exemplary multi flow control valve according to the present invention.

FIG. 6 is a schematic cross-sectional view of a multi flow control valve according to a third exemplary embodiment of the present invention. Referring to FIG. 6, a transmission oil outlet 610 and heater outlet 600 are formed at both sides of a valve housing 400, respectively.

An insert 630 having a pipe shape is inserted in the valve housing 400 in contact with the inner side of the valve housing and protrusions are formed toward the center on the inner side of the valve housing 400. The pipe-shaped insert 630 is fixed to the inner side of the valve housing 400 by the protrusions 620. That is, the insert 630 is disposed between the valve 320 and the valve housing 400.

The valve 320 is rotatably disposed inside the insert 630, the inner side of the insert 630 and the outer side of the valve 320 are slidably in close contact, and a driving unit such as a motor is provided to rotate the valve 320.

As shown in the figure, a coolant hole through which a coolant flows is formed in the valve 320 and a passage 632 corresponding to the coolant hole is formed in the insert 630.

An expansion space 500 is formed in the area except for the protrusions 620, between the inner side of the valve housing 400 and the outer side of the insert 630, and is connected with a transmission oil outlet 610 and a heater outlet 600, thereby making the entire flow of a coolant smooth.

For convenience in explanation and accurate definition in the appended claims, the terms "left" or "right", "inner" or "outer", and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. An engine having a multi flow rate control valve, comprising:

a valve having a hollow pipe structure and coolant holes through which a coolant supplied to a space at a center portion of the valve is to be distributed and cooled outside of the valve;

a valve housing coupled with the valve such that an inner side of the valve housing is capable of being in close contact with an outer side of the valve, and the valve housing having coolant outlets formed at positions corresponding to the coolant holes;

a driving unit for rotating the valve to selectively connect the respective coolant holes to the corresponding coolant outlets or close the coolant holes by bringing them in close contact with the inner side of the valve housing; and an insert having a pipe structure corresponding to the valve, disposed between the valve housing and the valve, fixed to the valve housing, and having a passage through which the coolant flows to one or more of the coolant outlets from the center portion of the valve, wherein protrusions that protrude toward the insert and fix the insert are formed on the inner side of the valve housing.

2. The engine having the multi flow rate control valve of claim 1, wherein the coolant holes include:

an engine bypass hole connected with a coolant line bypassing the engine;

a cylinder block hole connected with a coolant line for a cylinder block;

a heater hole connected with a coolant line for a heater;

a transmission oil hole connected with a coolant line for heating oil in a transmission; and a radiator hole connected with a coolant line for a radiator.

3. The engine having the multi flow rate control valve of claim 2, wherein the engine bypass hole, the cylinder block hole, the heater hole, the transmission oil hole, and the radiator hole are arranged in a predetermined order at predetermined distances in a longitudinal direction of the valve.

4. The engine having the multi flow rate control valve of claim 2, wherein the engine bypass hole, the cylinder block hole, the heater hole, the transmission oil hole, and the radiator hole are formed in angular areas in a rotational direction of the valve, respectively.

5. The engine having the multi flow rate control valve of claim 2, wherein the valve is rotated by a motor.

6. The engine having the multi flow rate control valve of claim 2, wherein the coolant outlets include:

an engine bypass outlet corresponding to the engine bypass hole;

a cylinder block outlet corresponding to the cylinder block hole;

a heater outlet corresponding to the heater hole;

a transmission oil outlet corresponding to the transmission oil hole; and a radiator outlet corresponding to the radiator hole.

7. The engine having the multi flow rate control valve of claim 6, wherein the cylinder block outlet includes a left cylinder block outlet corresponding to a left cylinder block and a right cylinder block outlet corresponding to a right cylinder block.

8. The engine having the multi flow rate control valve of claim 1, wherein the coolant holes are formed in areas in a rotational direction of the valve.

9. The engine having the multi flow rate control valve of claim 1, wherein an expansion space with a gap between the outer side of the valve and the inner side of the valve housing is formed on the inner side of the valve housing, corresponding to one or more of the coolant holes, and is connected with one or more of the coolant outlets.

10. The engine having the multi flow rate control valve of claim 1, wherein an expansion space with a gap between an outer side of the insert and the inner side of the valve housing is formed and connected with one or more of the coolant outlets.

* * * * *